US007334753B2

(12) United States Patent
Yu Chen

(10) Patent No.: US 7,334,753 B2
(45) Date of Patent: Feb. 26, 2008

(54) SEPARABLE PAPER STRIPPING DEVICE

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 377 days.

(21) Appl. No.: 11/088,815

(22) Filed: Mar. 25, 2005

(65) Prior Publication Data

US 2006/0213623 A1 Sep. 28, 2006

(51) Int. Cl.
*B65H 18/08* (2006.01)

(52) U.S. Cl. ..... 242/538.1; 242/538.2; 242/538.3; 156/584; 156/344

(58) Field of Classification Search ..... 242/538.1, 242/597.8, 588, 588.3, 588.6, 564, 538.2–538.3; 156/584, 344, 510
See application file for complete search history.

(56) References Cited

U.S. PATENT DOCUMENTS 4,115,180 A * 9/1978 Scalia ..... 156/446
4,240,867 A * 12/1980 Diegel ..... 156/543
4,274,904 A * 6/1981 Harrison et al. ..... 156/461
5,624,527 A * 4/1997 Maresh ..... 156/466
5,716,492 A * 2/1998 Li ..... 156/538
6,206,072 B1 * 3/2001 Orihara et al. ..... 156/540
6,620,239 B2 * 9/2003 Yen ..... 118/76
7,059,374 B2 * 6/2006 Mitsui et al. ..... 156/523

* cited by examiner

*Primary Examiner*—Peter M. Cuomo
*Assistant Examiner*—Sang Kim
(74) *Attorney, Agent, or Firm*—Ming Chow; Sinorica, LLC

(57) ABSTRACT

A separable paper-stripping device includes a base formed with a first and a second wall plate. The first wall plate is assembled thereon with a paper-roll holder, an idle gear and a separable-paper holder, and the second wall plate is secured thereon with a cutting member. The paper-roll holder is provided with a first gear able to actuate the second gear of the separable-paper holder to rotate through the idle gear. After a separable-paper roll is fitted on the paper-roll holder and the end of separable paper stripped from the separable-paper roll is fixed in the separable-paper holder, the sticking paper and the separable paper can be continuously separated from each other by pulling forward the end of the stripped sticking paper, and simultaneously the stripped separable paper can be rolled up by the separable-paper holder.

7 Claims, 8 Drawing Sheets

SEPARABLE PAPER STRIPPING DEVICE

BACKGROUND OF THE INVENTION

1. Field of the Invention

This invention relates to a separable paper stripping device, particularly to one able to separate sticking paper from separable paper easily and quickly.

2. Description of the Prior Art

Generally, a separable-paper roll is composed of sticking paper and separable paper that is pasted on one side or on both sides of the sticking paper. The separable paper and the sticking paper of a separable-paper roll have to be manually separated from each other first whenever the sticking paper is to be used for pasting, resulting in inconvenience in use. Therefore, various separable-paper stripping devices have been designed for facilitating stripping separable paper.

However, a conventional separable paper-stripping device is complicated in structure and it is provided with no device for controlling the tightness in rotation of a separable-paper roll for rolling up separable paper. Thus, the separable-paper roll is likely to become loosened and rotates randomly, and sticking paper may be pulled out too long or rotated backward and pasted randomly, causing much trouble in use.

SUMMARY OF THE INVENTION

The objective of the invention is to offer a separable paper-stripping device including a base formed with a first wall plate and a second wall plate. The first wall plate is axially assembled thereon with a paper-roll holder, an idle gear and a separable-paper holder, and the second wall plate has a cutting member fixed thereon. The paper-roll holder is provided with a first gear engaged with the idle gear for actuating the second gear of the separable-paper holder to rotate. After a separable-paper roll is fitted on the paper-roll holder and the separable paper stripped from the separable-paper roll has its end connected with the separable-paper holder, the sticking paper and the separable paper of the separable-paper roll can be easily separated from each other by pulling forward the end of the stripped sticking paper, and the stripped separable paper can be rolled up by the separable-paper holder, easy and convenient in use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
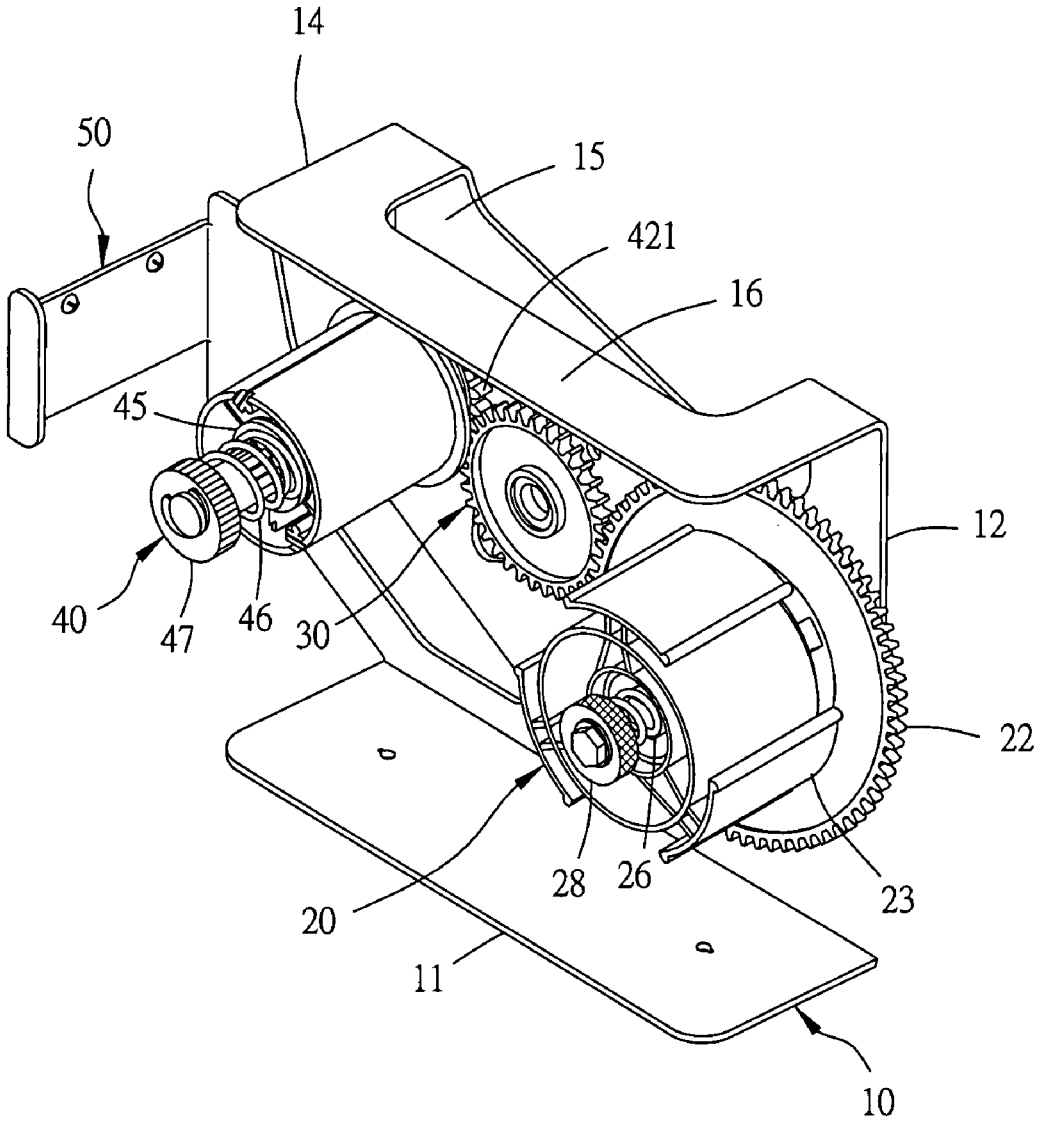
FIG. 1 is a perspective view of a first preferred embodiment of a separable paper-stripping device in the present invention.
Figure 2:
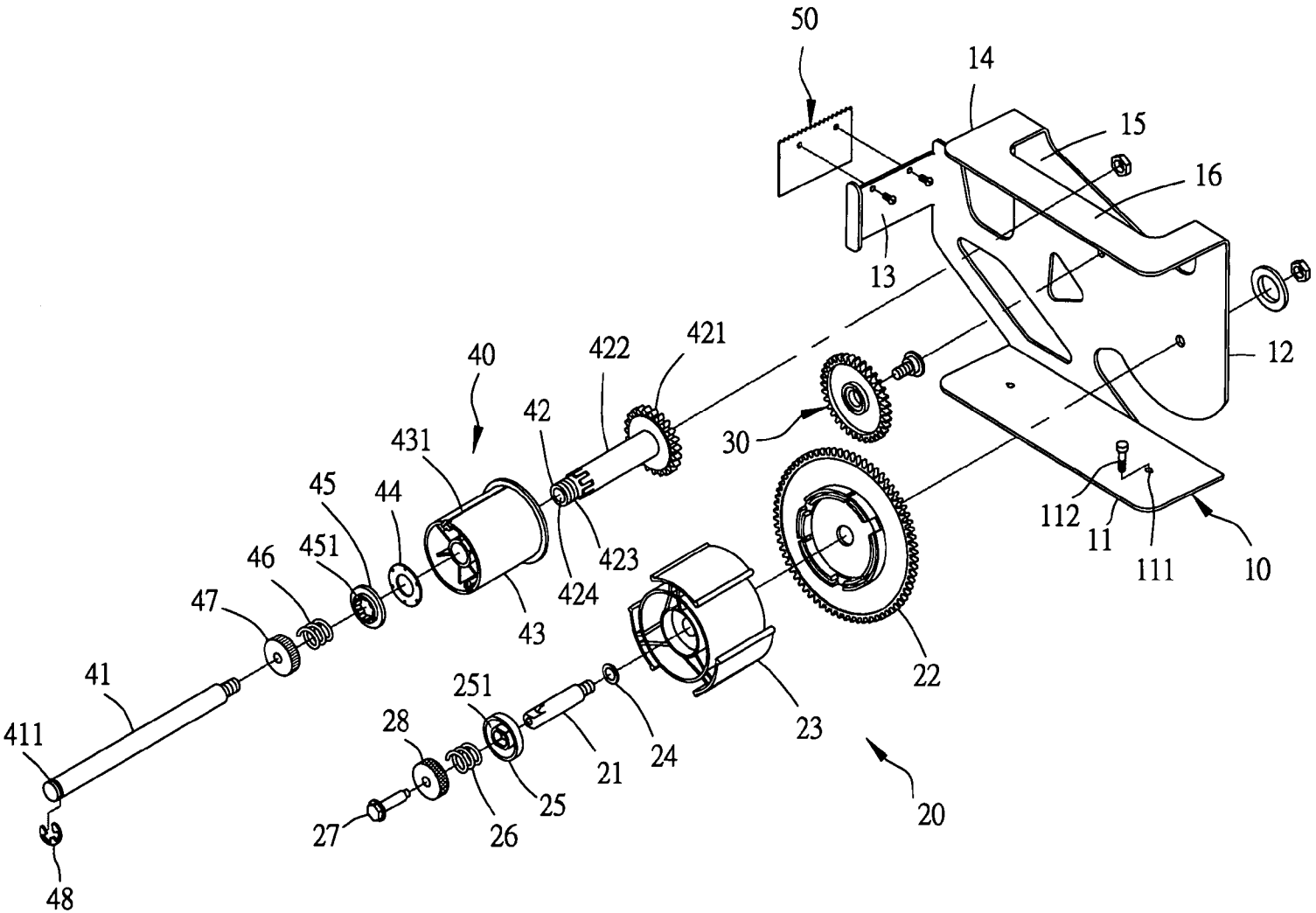
FIG. 2 is a partial exploded perspective view of the first preferred embodiment of the separable paper-stripping device in the present invention.
Figure 3:
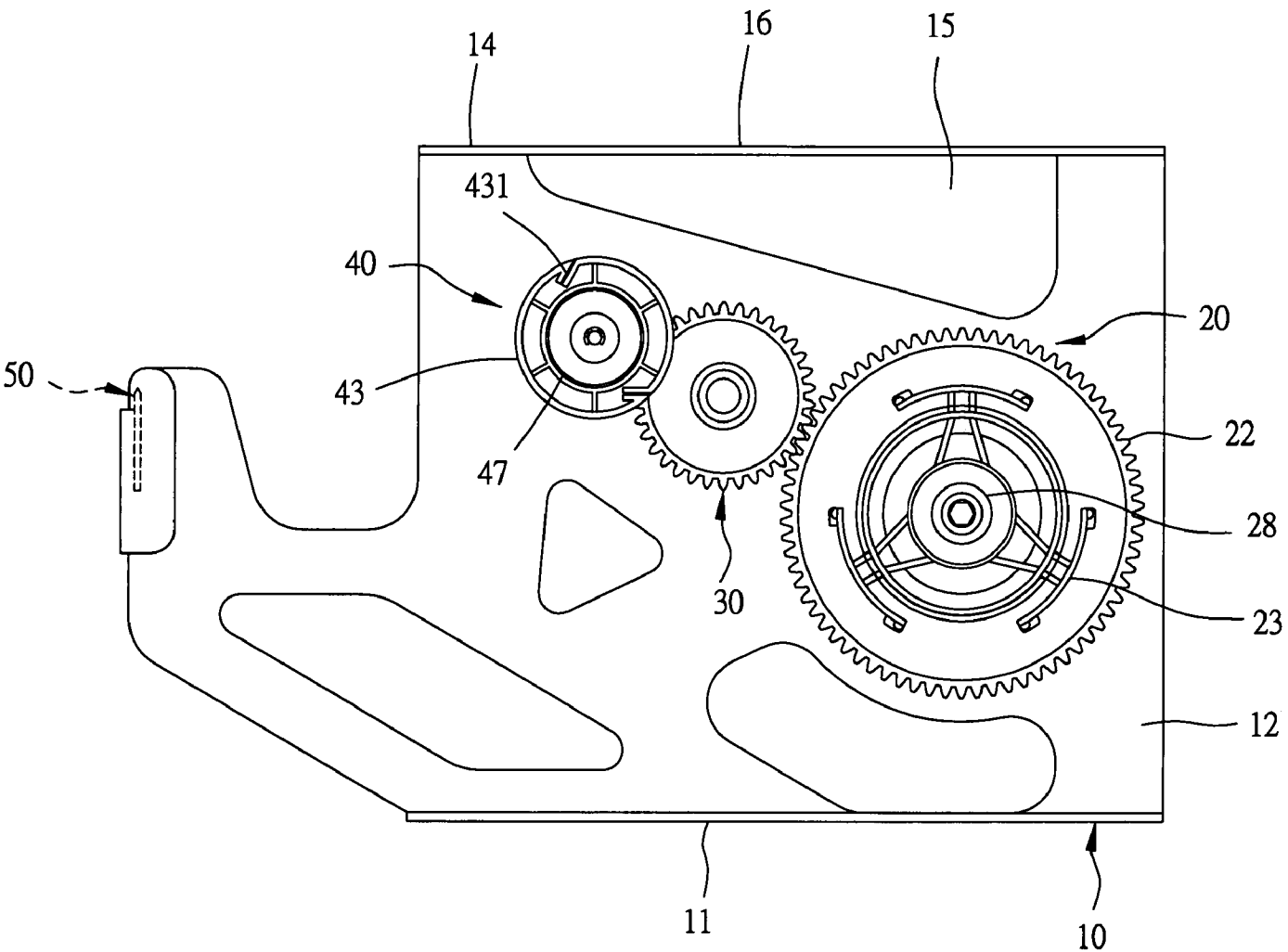
FIG. 3 is a front view of the first preferred embodiment of the separable paper-stripping device in the present invention.

A first preferred embodiment of a separable paper stripping device in the present invention, as shown in FIGS. 1 to 6, includes a base 10, a paper-roll holder 20, an idle gear 30, a separable-paper holder 40 and a cutting member 50 combined together.

The base 10 is formed with a bottom plate 11 having its opposite sides respectively bored with an insert hole 111 at a proper location for a bolt 112 to be inserted therein to fix the bottom plate 11 on a flat stand. The bottom plate 11 has one side extending upward vertically and forming a first wall plate 12 that has its left side extending transversely to form a second wall plate 13 and has its upper end bent properly to form a third wall plate 14. A hole 15 is bored in the bent portion between the first and the third wall plates 12 and 14, letting the third wall plate 14 positioned at the outer side of the hole 15 serve as a grip 16.

Figure 4:
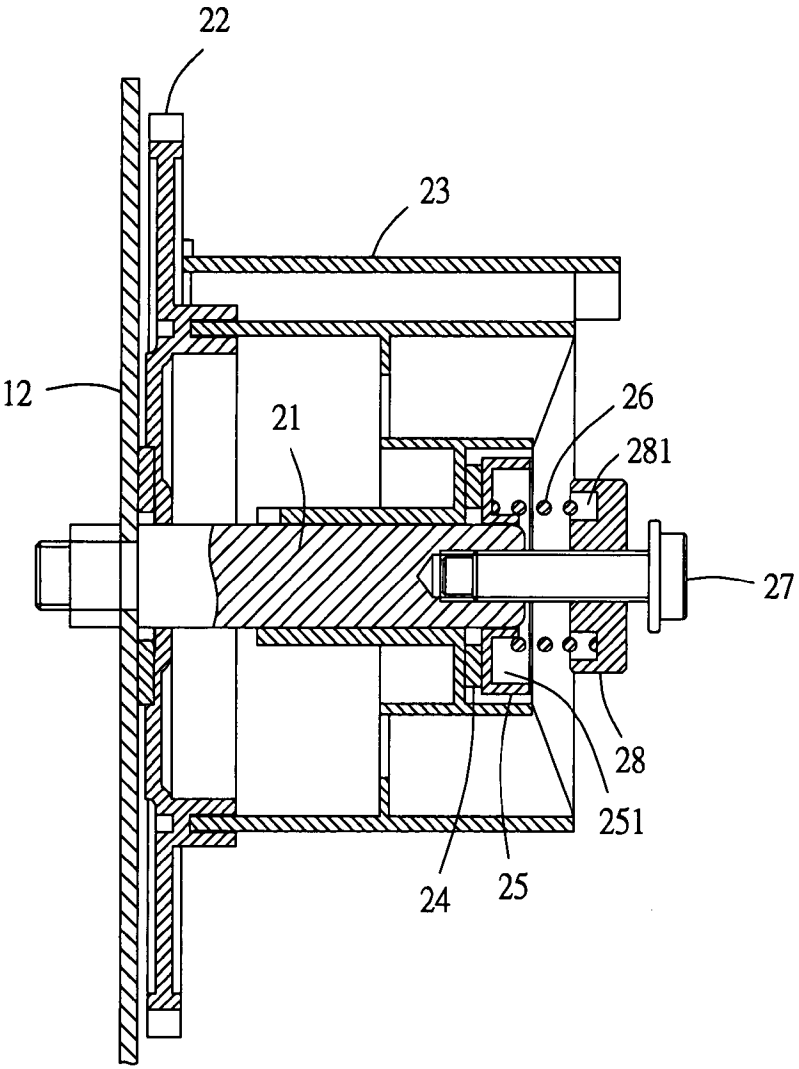
FIG. 4 is a side cross-sectional view of the first preferred embodiment of a paper-roll holder in the present invention.

The paper-roll holder 20, as shown in FIG. 4, is provided with a shaft 21 having one end firmly fixed at a proper portion of the right side of the first wall plate 12 of the base 10. The shaft 21 is pivotally and orderly fitted thereon with a first gear 22 and a tubular member 23 engaged with the first gear 22 for rotating together with the first gear 22. The shaft 21 is also orderly fitted thereon with a soft washer 24 received in the central portion of the outer end of the tubular member 23 and a spring position member 25 having its outer end bored with an annular recessed groove 251 for receiving the inner end of a compression spring 26. Further, the shaft 21 has its outer end connected with a bolt 27 threadably engaging thereon with an adjusting nut 28 having its inner side bored with a recess 281 for receiving the outer end of the compression spring 26. Thus, the adjusting nut 28 can be properly turned around to adjust the elasticity of the compression spring 26 pressing the tubular member 23 and simultaneously controlling the rotary tightness of both the tubular member 23 and the first gear 22.

The idle gear 30 is axially installed on the first wall plate 12 at a location abutting the left upper side of the paper-roll holder 20 and engages with the first gear 22 of the paper-roll holder 20 for rotating together.

Figure 5:
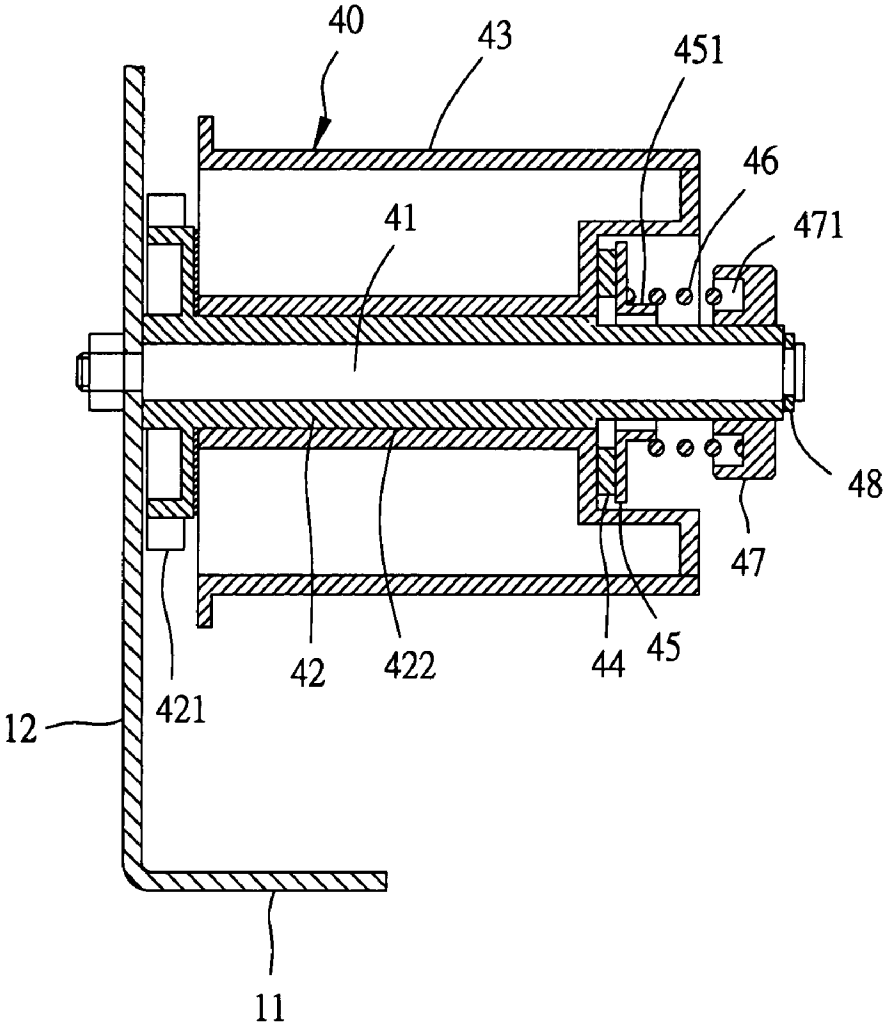
FIG. 5 is a side cross-sectional view of the first preferred embodiment of a separable-paper holder in the present invention.

The separable-paper holder 40, as shown in FIG. 5, is provided with an elongate shaft 41 having one end secured on the first wall plate 12 at a location abutting the left side of the idle gear 30 and the other end bored with an annular groove 411. A second gear 42 is assembled on the shaft 41 and provided with a gear portion 421 and a tubular shaft 422 extending outward from the center of the outer side of the gear portion 421 and having its outer end formed with male threads 423. The gear portion 421 and the tubular shaft 422 have their inner center bored with a lengthwise shaft hole 424 for the shaft 41 to be inserted therethrough, letting the gear 421 closely rest on the first wall plate 12 and engaged with the idle gear 30 for rotating together. The tubular shaft 422 of the second gear 42 is orderly fitted thereon with a cylindrical member 43 and a metallic washer 44 firmly fitting around the outer end of the cylindrical member 43 that has its outer circumference bored with two oblique positioning slots 431 for the end of stripped separable paper to be inserted and positioned therein. A spring position member 45 is fitted on the tubular shaft 422 of the second gear 42, closely pushing against the metallic washer 44 and having the center of its outer end extending outward to form a position portion 451 for receiving the outer end of a compression spring 46. An adjusting nut 47 is screwed with the male threads 423 of the tubular shaft 422 of the second gear 42, having its inner side bored with a recess 471 for receiving the outer end of the compression spring 46. A helical spring lock ring 48 is fitted in the annular groove 411 at the outer end of the shaft 41 for fixing the second gear 42 and the adjusting nut 47 in position. Thus, the adjusting nut 47 can be properly turned around to adjust the elasticity of the compression spring 46 acting on the tubular member 43 and controlling the rotary tightness of both the cylindrical member 43 and the second gear 42.

The cutting member 50 is secured on the second wall plate 13 for cutting off the sticking paper stripped from a separable-paper roll 60.

Figure 6:
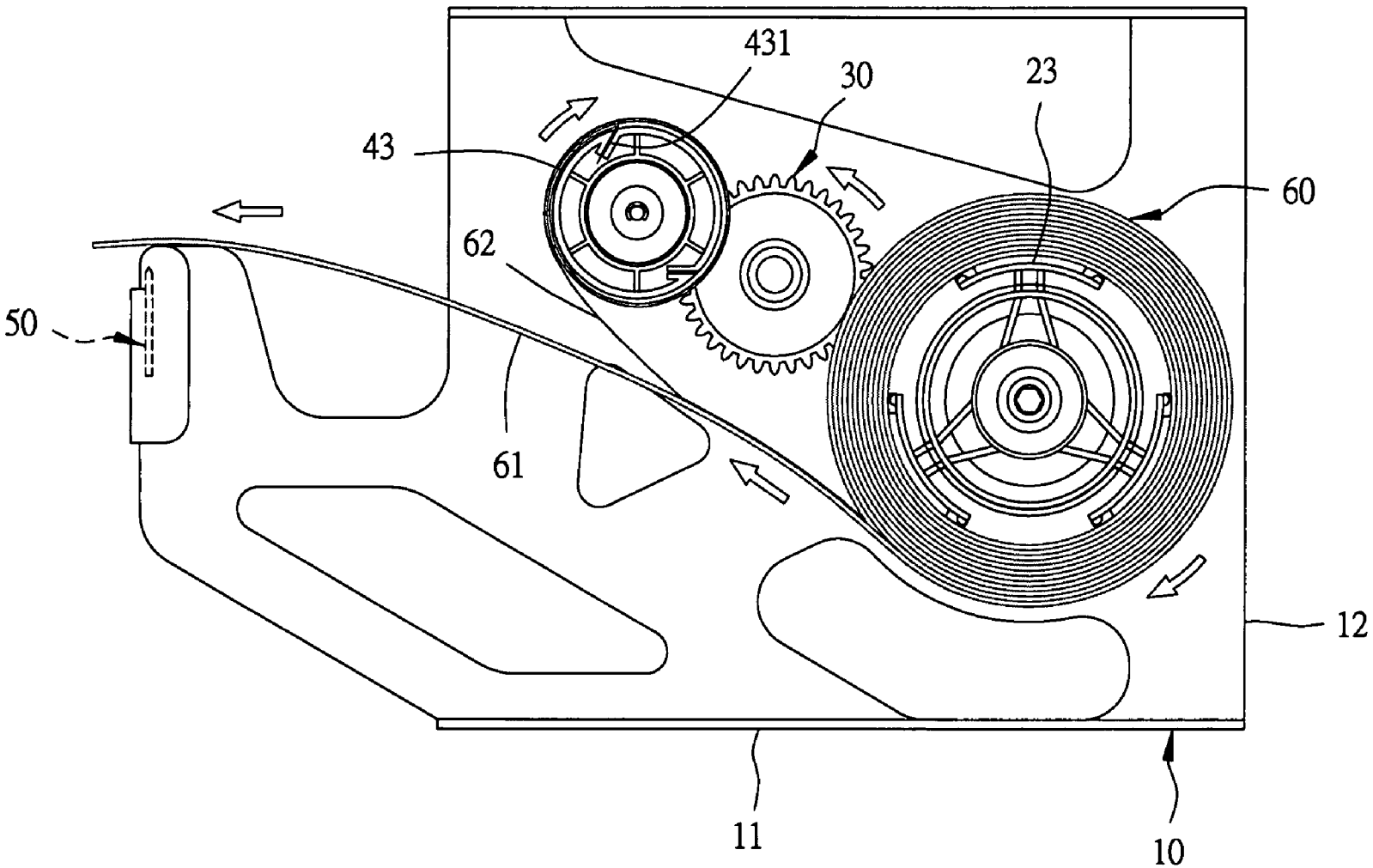
FIG. 6 is a cross-sectional view of the first preferred embodiment of the separable paper-stripping device in a stripping condition in the present invention.

In assembling, as shown in FIG. 6, firstly, the separable-paper roll 60 is firmly fitted on the paper-roll holder 20 and has the outer end of the sticking paper 61 and the separable paper 62 of the separable-paper roll 60 separated from each other in advance. Subsequently, the separable paper 62 is extended leftward and upward to pass over the tubular member 43 of the separable-paper holder 40 and then has its outer end inserted and positioned in the positioning groove 431 in the outer circumference of the cylindrical member 43. At this time, the stripped sticking paper 61 positioned under the separable paper 62 can be pulled to move leftward and actuate the separable-paper roll 60 to rotate together with the paper-roll holder 20. Simultaneously, the first gear 22 of the paper-roll holder 20, the idle gear 30 and the second gear 42, which are engaged mutually, will actuate the separable-paper holder 40 to rotate, enabling the separable-paper roll 60 to continuously release sticking paper 61 and separable paper 62 leftward. Since the separable-paper holder 40 is located above the left upper side of the paper-roll holder 20, there forms a contained angle between the separable-paper holder 40 and the moving route of the stripped sticking paper 62 pulled; therefore, the sticking paper 61 and the separable paper 62 continuously released from the separable-paper roll 60 can be always kept in a separated condition beneath the separable-paper holder 40, and the stripped separable paper 62 can be rolled up by the separable-paper holder 40. Thus, the sticking paper 61 stripped and having its sticking side facing upward can be smoothly employed for pasting and properly cut off by the cutting member 50 on the second wall plate 13. After finishing pasting, the stripped sticking paper 61 can have its back side temporarily set on the cutting member 50 for subsequent use.

Figure 7:
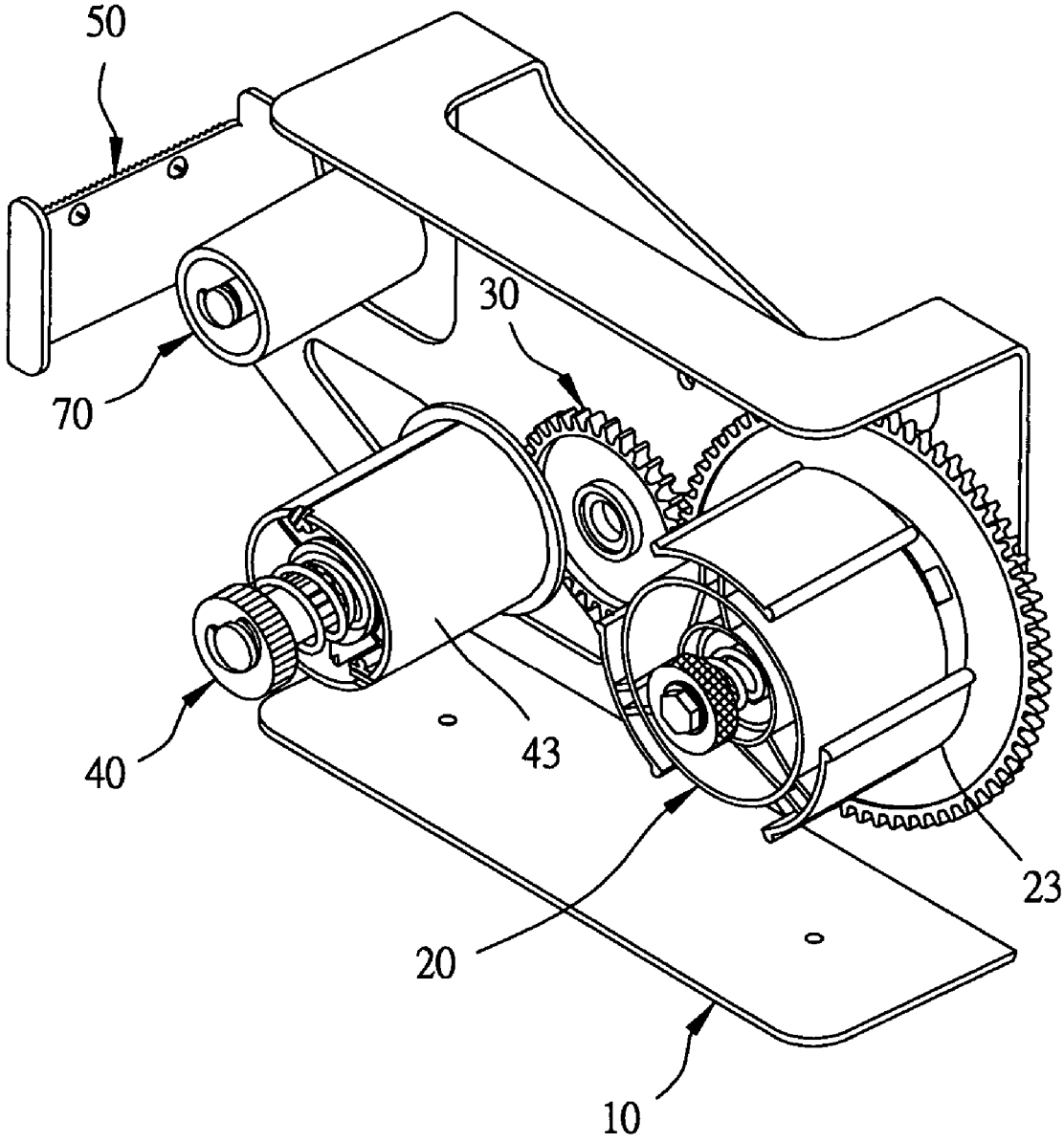
FIG. 7 is a perspective view of a second preferred embodiment of a separable paper-stripping device in the present invention.
Figure 8:
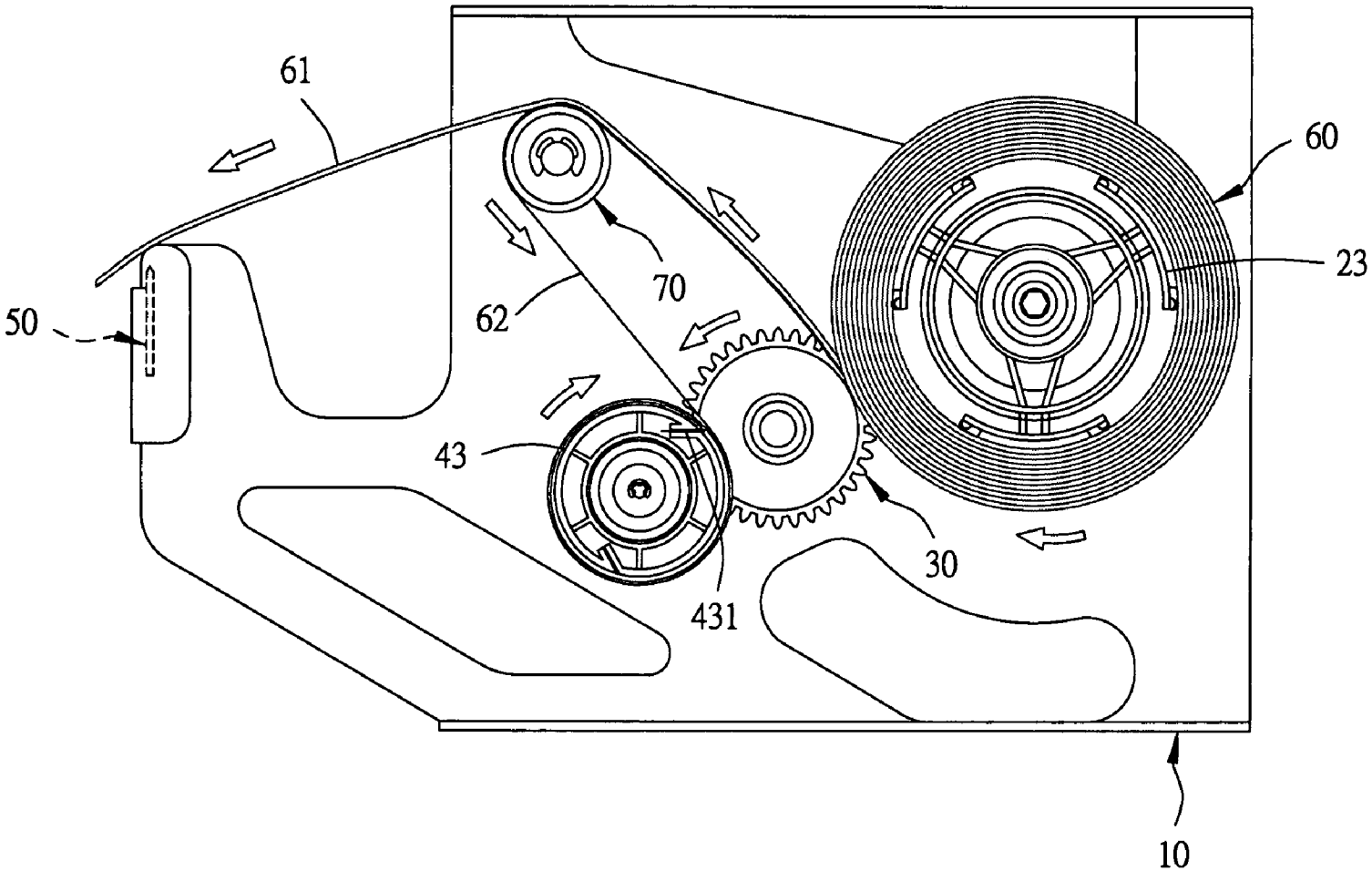
FIG. 8 is a cross-sectional view of the second preferred embodiment of the separable paper-stripping device under the condition of carrying out stripping in the present invention.

A second preferred embodiment of a separable paper stripping device in the present invention, as shown in FIGS. 7 and 8, includes a base 10, a paper-roll holder 20, an idle gear 30, a separable-paper holder 40, a cutting member 50 and a stripping roller 70 combined together.

The idle gear 30 is axially fixed on the first wall plate 12 of the base 10 at a location abutting the left lower side of the paper-roll holder 20. The separable-paper holder 40 is axially assembled on the first wall plate 12 of the base 10 at a location abutting the left lower side of the idle gear 30. The stripping roller 70 is disposed on the first wall plate 12 of the base 10 at a location above the left upper side of the separable-paper holder 40. After a separable-paper roll 60 is fitted on the paper-roll holder 20 and the separable paper 62 and the sticking paper 61 on the outer end of the separable-paper roll 60 are separated from each other, the stripped separable paper 62 is extended leftward and upward to pass over the stripping roller 70 and then extended rightward and downward to reach the separable-paper holder 40 and have its outer end inserted in the positioning slot 431 in the outer circumference of the cylindrical member 43 of the separable-paper holder 40. At this time, when the stripped sticking paper 61 positioned above the separable paper 62 is pulled leftward, the separable-paper roll 60 will actuate the paper-roll holder 20 to rotate, and simultaneously the first gear 22 of the paper-roll holder 20, the idle gear 30 and the second gear 42, which are engaged mutually, will actuate the separable-paper holder 40 to rotate, enabling the separable-paper roll 60 to continuously release separable paper 62 and sticking paper 61. Since the stripping roller 70 is positioned above the left and upper side of the paper-roll holder 20 and the separable-paper holder 40 is positioned beneath the right and lower side of the stripping roller 70, there forms a contained angle between the separable paper 62 positioned on the stripping roller 70 and the moving route of the stripped sticking paper 61 pulled. Therefore, the sticking paper 61 and the separable paper 62 released continuously from the separable-paper roll 60 can be always kept in a separated condition, and the stripped separable paper 62 can be rolled up by the separable-paper holder 40. Thus, the sticking paper 61 stripped and having its sticking side facing downward can be smoothly employed for pasting and properly cut off by the cutting member 50 on the second wall plate 13. After finishing pasting, the stripped sticking paper 61 can have its sticking side temporarily stuck on the cutting member 50 for subsequent use.

As can be understood from the above description, this invention has the following advantages.

1. The separable paper-stripping device of this invention can be carried about or secured on a flat stand for use.

2. It is easy to install any separable-paper roll 60 on the separable paper-stripping device of this invention and separate the sticking paper 61 from the separable paper 62 of a separable-paper roll 60.

3. The rotary tightness of both the paper-roll holder 20 and the separable-paper hold 40 can be adjusted; therefore, the separable-paper roll 60 fitted on the paper-roll holder 20 and the separable paper 62 of the separable-paper holder 40 can be prevented from becoming loosened and rotating randomly, ensuring stability and smoothness of stripping work.

4. It is simple in structure and easy in producing and assembling.

While the preferred embodiments of the invention have been described above, it will be recognized and understood that various modifications may be made therein and the appended claims are intended to cover all such modifications that may fall within the spirit and scope of the invention.

I claim:

1. A separable paper stripping device comprising:

a base formed with a first wall plate extending upward vertically, said first wall plate having one preset side extending transversely and forming a second wall plate;

a paper-roll holder axially installed at a preset portion of said first wall plate of said base, said paper-roll holder fitted thereon with a separable-paper roll for rotating together, said paper-roll holder provided with a first gear;

an idle gear axially fixed on said first wall plate of said base at a location abutting said paper-roll holder, said idle gear engaged with said first gear member of said paper-roll holder for rotating together;

a separable-paper holder axially disposed on said first wall plate of said base at a location abutting said idle gear, said separable-paper holder positioning the outer end of separable paper stripped from said separable-paper roll, said separable-paper holder provided with a second gear, said second gear engaged with said idle gear for rotating together, said separable-paper holder actuated to rotate by said paper-roll holder, said separable-paper holder rotating and rolling up said separable paper stripped from said separable-paper roll; and a cutting member secured on said second wall plate of said base for cutting off sticking paper stripped from said separable-paper roll, wherein said separable-paper holder is positioned beneath the left lower side of said paper-roll holder, and a stripping roller is axially disposed on said first wall plate of said base at a location above the left upper side of said separable-paper holder so that said separable paper on said separable-paper roll can be extended upward and leftward to pass over the upper side of said stripping roller and then extended downward and rightward to be rolled up by said separable-paper holder, enabling said separable paper and said sticking paper to be separated from each other at the upper side of said stripping roller.

2. The separable paper stripping device as claimed in claim 1, wherein said separable-paper holder has an outer circumference axially bored with at least one oblique positioning slot for the outer end of said separable paper to be inserted and positioned therein.

3. The separable paper stripping device as claimed in claim 1, wherein said first wall plate of said base has an upper end bent to form a third wall plate, with a hole bored at the bent portion between said first and said third wall plate to let said third wall plate serve as a grip.

4. The separable paper stripping device as claimed in claim 1, wherein said base is formed with a bottom plate having a preset side extending upward vertically and forming said first wall plate, said bottom plate bored with plural insert holes at proper locations, with bolts respectively inserted in said insert holes to fix said bottom plate on a flat stand.

5. The separable paper stripping device as claimed in claim 1, wherein said separable-paper holder is positioned above the left upper side of said paper-roll holder so that said separable paper on said separable-paper roll can be extended to the lower side of said separable-paper holder and positioned thereon, and separable paper and sticking paper to be separated from each other at a location beneath said separable-paper holder.

6. A separable paper stripping device comprising:

a base formed with a first wall plate extending upward vertically, said first wall plate having one preset side extending transversely and forming a second wall plate;

a paper-roll holder axially installed at a preset portion of said first wall plate of said base, said paper-roll holder fitted thereon with a separable-paper roll for rotating together, said paper-roll holder provided with a first gear;

an idle gear axially fixed on said first wall plate of said base at a location abutting said paper-roll holder, said idle gear engaged with said first gear member of said paper-roll holder for rotating together;

a separable-paper holder axially disposed on said first wall plate of said base at a location abutting said idle gear, said separable-paper holder positioning the outer end of separable paper stripped from said separable-paper roll, said separable-paper holder provided with a second gear, said second gear engaged with said idle gear for rotating together, said separable-paper holder actuated to rotate by said paper-roll holder, said separable-paper holder rotating and rolling up said separable paper stripped from said separable-paper roll; and a cutting member secured on said second wall plate of said base for cutting off sticking paper stripped from said separable-paper roll, wherein said paper-roll holder is provided with a shaft having one end firmly fixed on said first wall plate of said base, said shaft orderly and pivotally connected with said first gear and a tubular member engaged with said first gear member, said tubular member fitted thereon with said separable-paper roll and able to rotate together with said first gear, said shaft also orderly fitted thereon with a soft washer and a spring position member, said soft washer received in the central portion of the outer end of said tubular member, said spring position member having an outer side bored with a recess for receiving the inner end of a compression spring, said shaft having an outer end connected with a bolt screwed with an adjusting nut, said adjusting nut having an inner side bored with a recess for receiving the outer end of said compression spring, said adjusting nut able to be turned and adjusted in position for controlling the elasticity of said compression spring, said compressing spring accordingly controlling the rotary tightness of both said tubular member and said first gear member.

7. A separable paper stripping device comprising:

a base formed with a first wall plate extending upward vertically, said first wall plate having one preset side extending transversely and forming a second wall plate;

a paper-roll holder axially installed at a preset portion of said first wall plate of said base, said paper-roll holder fitted thereon with a separable-paper roll for rotating together, said paper-roll holder provided with a first gear;

an idle gear axially fixed on said first wall plate of said base at a location abutting said paper-roll holder, said idle gear engaged with said first gear member of said paper-roll holder for rotating together;

a separable-paper holder axially disposed on said first wail plate of said base at a location abutting said idle gear, said separable-paper holder positioning the outer end of separable paper stripped from said separable-paper roll, said separable-paper holder provided with a second pear, said second gear engaged with said idle gear for rotating together, said separable-paper holder actuated to rotate by said paper-roll holder, said separable-paper holder rotating and rolling up said separable paper stripped from said separable-paper roll; and a cutting member secured on said second wall plate of said base for cutting off sticking paper stripped from said separable-paper roll, wherein said separable-paper holder is provided with a shaft having one end secured on said first wall plate of said base and the other end bored with an annular groove, and said second gear of said separable-paper holder is composed of a gear portion closely resting on said first wall plate and a tubular shaft extending outward from the inner side of said gear portion, said gear portion and said tubular shaft bored with a central shaft hole to be pivotally fitted on said shaft, said tubular shaft having an outer end formed with male threads, said tubular shaft of said gear portion orderly fitted thereon with a cylindrical member, a washer fitting around the outer end of said cylindrical member and a spring position member, said spring position member having an outer end formed with a positioning portion extending outward from the center, said positioning portion of said spring position member receiving the inner end of a compression spring, an adjusting nut screwed with said male threads of said tubular shaft of said second gear, said adjusting nut having an inner side bored with a recess for receiving the outer end of said compression spring, a helical spring lock ring engaged in said annular groove of said shaft for fixing said second gear and said adjusting nut in position, said adjusting nut able to be adjusted in position to control the elasticity of said compression spring, which then controls the rotary tightness of both said cylindrical member and said second gear member.

* * * * *